United States Patent [19]

Hayashi et al.

[11] Patent Number: 4,695,329

[45] Date of Patent: Sep. 22, 1987

[54] METHOD FOR MANUFACTURING A CYLINDER HEAD OF CAST ALUMINUM ALLOY FOR INTERNAL COMBUSTION ENGINES BY EMPLOYING LOCAL HEAT TREATMENT

[75] Inventors: Souichi Hayashi, Nagoya; Johji Miyake, Okazaki; Mototsugu Koyama; Kanji Sakaguchi, both of Toyota, all of Japan

[73] Assignee: Toyota Jidosha Kabushiki Kaisha, Japan

[21] Appl. No.: 831,708

[22] Filed: Feb. 20, 1986

[30] Foreign Application Priority Data

Feb. 21, 1985 [JP] Japan ..... 60-31627

[51] Int. Cl.[4] ..... C21D 1/09; B22D 25/00; C22F 1/00

[52] U.S. Cl. ..... 148/3; 29/156.4 R; 29/DIG. 24; 148/4; 164/76.1; 123/193 H

[58] Field of Search ..... 29/156.4 R, DIG. 24; 164/76.1; 75/10.11; 148/DIG. 903, 3, 4; 219/121 EF, 121 EG, 121 PA, 121 PB, 121 LC, 121 LD; 123/193 H

[56] References Cited

U.S. PATENT DOCUMENTS 4,157,923 6/1979 Yen et al. ..... 148/4
4,336,076 6/1982 Edamura et al. ..... 148/3
4,411,709 10/1983 Nakanishi ..... 148/3

OTHER PUBLICATIONS

Wakefield, Brian D., "Laser Right on the Beam for Heat Treating Duty", *Iron Age*, (Feb. 10, 1975), pp. 45–47.

Van Cleave, David A., "Lasers Permit Precision Surface Treatments", *Iron Age* (Jan. 31, 1977), pp. 25–27.

*Primary Examiner*—Howard N. Goldberg
*Assistant Examiner*—Ronald S. Wallace
*Attorney, Agent, or Firm*—Parkhurst & Oliff

[57] ABSTRACT

A method for making a cylinder head cast from an aluminum alloy intended for use in internal combustion engines, and more particularly, a method for improving a portion of the cylinder head by a local heat treatment, comprises casting a cylinder head body from an aluminum alloy, directing a high density energy, such as TIG arc, laser, plasma arc or electron beam, to the surface of at least one region of the cylinder head body where a high strength is required, thereby rapidly remelting a surface layer in that region, and subsequently removing the irradiating energy and allowing the molten aluminum alloy of the surface layer to be rapidly cooled and solidified through heat transfer therefrom to the underlying matrix thereby forming a remelted, solidified layer.

7 Claims, 10 Drawing Figures

METHOD FOR MANUFACTURING A CYLINDER HEAD OF CAST ALUMINUM ALLOY FOR INTERNAL COMBUSTION ENGINES BY EMPLOYING LOCAL HEAT TREATMENT

This invention relates to a method for making a cylinder head cast from an aluminum alloy and intended for use in internal combustion engines, and more particularly, to a method for improving a portion of the cylinder head by a local heat treatment.

BACKGROUND OF THE INVENTION

In recent years, an increasing number of cylinder heads cast from aluminum alloy were used in internal combustion engines. Aluminum alloys have excellent properties of light weight, high thermal conductivity, and superior heat resistance as compared with other light alloys. The aluminum alloys, however, have some problems that they tend to absorb hydrogen gas in molten state and undergo substantial solidification shrinkage. Thus castings often contain casting defects such as pin holes, blow holes, and shrinkage cavities. It is also known that with the slower cooling of molten aluminum alloy, more casting defects occur and even the solidification structure becomes coarser. The mechanical properties of cast aluminum alloys largely depend on the cooling rate during casting and become poor as the cooling rate is reduced.

Cylinder heads for use in internal combustion engines generally have such a large size and a complicated shape that the cooling rate is low during casting. Thus, internal combustion engine cylinder heads cast from aluminum alloys exhibit mechanical properties which are not necessarily sufficient for the above-mentioned reason. Cracks are likely to occur in the combustion chamber-defining wall due to thermal stresses during service.

Thermal stresses induced in internal combustion engine cylinder heads during service are not even over the entirety. Several local areas are highly stressed. Generally, such high load areas include that region interposed beween valve seats of an exhaust port and an intake port, also known as inter-valve region, those regions extended between the valve seats and a port for communication with an auxiliary combustion chamber, that region surrounding the auxiliary combustion chamber communicating port, and that region surrounding an aperture for receiving a spark plug therein. A majority of cracks occur in these regions due to thermal stresses during service. To accommodate particularly high requirements of mechanical properties in these high load regions, the following approaches were made in the prior art.

Modifications were made in molds and cores used in the casting of aluminum alloy in order to improve the mechanical properties of a predetermined portion of the resulting aluminum alloy casting where a high load would be applied. One approach is to increase the wall thickness of the predetermined portion with a design change in size and shape. A second approach is the attachement of a chiller. A sand core is provided with a chiller at a location corresponding to the predetermined portion of the resulting aluminum alloy casting. The cooling rate of the predetermined portion in contact with the chiller is then locally increased. A third approach is by placing a water cooling pipe in a mold in proximity to the predetermined portion of the resulting aluminum alloy casting to locally and forcedly cool the portion.

These prior art approaches have more or less severe problems. The first approach loses the advantages of compactness and light weight characteristic of the use of aluminum alloy because a change of design is required to increased the wall thickness.

In the second approach, the sand core itself becomes very complicated in shape and is thus difficult to mold. In order to cool at the necessary rate internal combustion engine cylinder heads which are large sized castings, the chiller must have a substantially high thermal capacity. In actual practice, however, it is difficult to attach a chiller having such a high thermal capacity. Consequently, the second approach is less effective in improving the quality of castings.

The third approach based on water cooling is truly superior in cooling capacity to the second approach. Nevertheless, the mold itself becomes very complicated in structure. It is very difficult to introduce water to the necessary portion as desired. The attempt is thus unsuccessful in improving the quality of castings to the required extent. In addition, the third approach is difficult to apply to commercial molds from the standpoint of safety because water is introduced in the proximity of molten aluminum alloy.

SUMMARY OF THE INVENTION

It is, therefore, an object of the present invention to provide a novel and improved method for manufacturing a cylinder head of cast aluminum alloy for internal combustion engines whereby the mechanical properties of a region of the cast cylinder head where subsequent application of a high load is expected is sufficiently improved while maintaining the advantages of compactness and light weight attributable to the use of aluminum alloy.

According to the present invention, there is provided a method for manufacturing a cylinder head of cast aluminum alloy for internal combustion engines, comprising the steps of casting a cylinder head body from an aluminum alloy by a conventional casting process, directing a high density energy, for example, TIG arc and laser to the surface of at least one region of the cylinder head body where a high strength is required, for example, a region between valve seats of exhaust and intake ports, thereby rapidly remelting a surface layer in the region, and subsequently removing the irradiating energy and allowing the molten aluminum alloy of the surface layer to be rapidly cooled and solidified through heat transfer therefrom to the underlying matrix, thereby forming a remelted, solidified layer.

After casting, only a surface layer of the predetermined region is quickly remelted by the use of a high density energy and then quickly solidified. Then the surface layer is directionally solidified from the underlying matrix to the surface so that casting defects, such as light shrinkage cavities, pin holes, and blow holes disappear as if they were forced out of the surface, resulting in a defect-free structure. At the same time, rapid solidification renders the structure of the region finer to outstandingly improve the mechanical properties thereof.

BRIEF DESCRIPTION OF THE DRAWINGS

The above and other objects, features, and advantages will be better understood by reading the following description taken in conjunction with the accompanying drawings, in which.

DETAILED DESCRIPTION OF THE INVENTION

The cylinder heads of the present invention may be cast from any of casting aluminum alloys traditionally used in the casting of cylinder heads for use in internal combustion engines. Some illustrative, non-limiting examples of the aluminum alloys used herein include hypo-eutectic alloys such as JIS AC2B alloys (Cu 2.0–4.0 wt %, Si 5.0–7.0 wt %, Mg<0.5 wt %, Zn<1.0 wt %, Fe<1.0 wt %, Mn<0.5 wt %, Ni<0.3 wt %, Ti<0.2 wt %, balance Al), JIS AC4B alloys (Cu 2.0–4.0 wt %, Si 7.0–10.0 wt %, Mg<0.5 wt %, Zn<1.0 wt %, Fe<1.0 wt %, Mn<0.5 wt %, Ni<0.3 wt %, Ti<0.2 wt %, balance Al), JIS AC4C alloys (Cu<0.2 wt %, Si 6.5–7.5 wt %, Mg 0.20–0.4 wt %, Zn<0.3 wt %, Fe<0.5 wt %, Mn<0.3 wt %, Ti<0.2 wt %, balance Al); eutectic alloys such as JIS AC8A alloys (Cu 0.8–1.3 wt %, Si 11.0–13.0 wt %, Mg 0.7–1.3 wt %, Zn<0.1 wt %, Fe<0.8 wt %, Mn<0.1 wt %, Ni 1.0–2.5 wt %, Ti<0.2 wt %, balance Al);

hyper-eutectic alloys such as

AA A390 alloys (Cu 4.0–5.0 wt %, Si 16.0–18.0 wt %, Mg 0.45–0.65 wt %, Zn<0.10 wt %, Fe<0.50 wt %, Mn<0.10 wt %, Ti<0.20 wt %, balance Al); and JIS AC5A alloys (Cu3.5–4.5 wt %, Si<0.6 wt %, Mg 1.2–1.8 wt %, Zn<0.1 wt %, Fe<0.8 wt %, Mn<0.3 wt %, Ni 1.7–2.3 wt %, Ti<0.2 wt %, balance Al).

JIS and AA are abbreviations of Japanese Industrial Standard and U.S. Aluminum Associate Standard.

A cylinder head body is first cast from any of these aluminum alloys. The casting process may be any desired one of well-known processes for the casting of cylinder heads from aluminum alloy, for example, low pressure mold casting and high pressure mold casting processes.

The cast cylinder head body, after optional machining, is then subject to a rapid remelting treatment by directing a high density energy to one or more selected regions thereof where a high strength is required, that is, high load regions.

Figure 1:
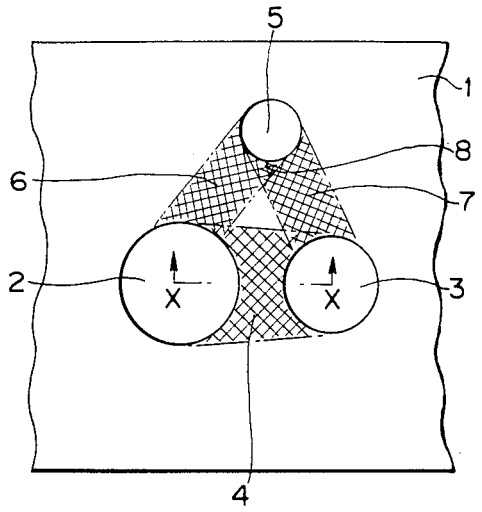
FIG. 1 is a plan view of a cylinder head for use in a Diesel engine to which the present method is applied, showing the inner or combustion chamber-defining surface of a selected portion thereof.

These regions will be specifically described by referring to the figures. A combustion chamber-defining surface of a typical Diesel engine cylinder head is shown in FIG. 1. The illustrated cylinder head 1 is provided with intake and exhaust ports 2 and 3 in which valve seats are usually formed or fitted as well as a part 5 in communication with an optional auxiliary combustion chamber (not shown). Then the selected regions of the cylinder head body include a region 4 extended between the intake and exhaust ports 2 and 3, that is, an inter-valve region, regions 6 and 7 extended between the port 5 and the intake and exhaust ports 2 and 3, and a region 8 surrounding the port 5.

Figure 3:
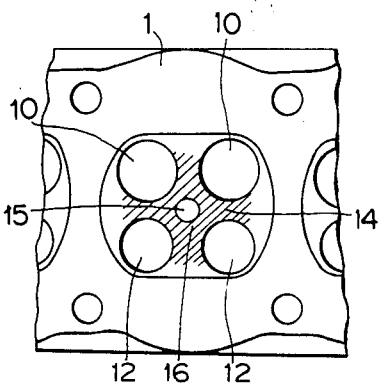
FIGS. 2 and 3 are plan views of different cylinder heads for use in a gasoline engine to which the present method is applied, showing the inner or combustion chamber-defining surface of a selected portion thereof, respectively.
Figure 2:
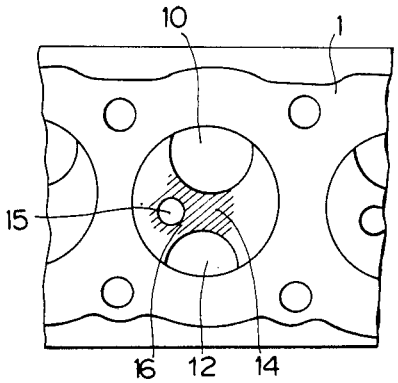

A combustion chamber-defining surface of a typical gasoline engine cylinder head is shown in FIGS. 2 and 3. The illustrated cylinder head 1 is provided with intake and exhaust ports 10 and 12 in which valve seats are usually formed or fitted as well as an aperture 15 in which a spark plug (not shown) is received. Then the selected regions of the cylinder head body include regions 14 extended between the intake and exhaust ports 10 and 12, that is, an intervalve regions, regions extended between the aperture and the intake and exhaust ports, and a region 16 surrounding the aperture 15.

The remelting treatment according to the present invention may be carried out on one or more of these selected regions. The high density energies used herein include TIG arc, plasma arc, laser, and electron beams.

When the selected region of the cylinder head body is irradiated with a high density energy, the energy is directed to the region at a spot. Generally, the spot of irradiating energy is moved relative to the cylinder head surface.

Figure 4:
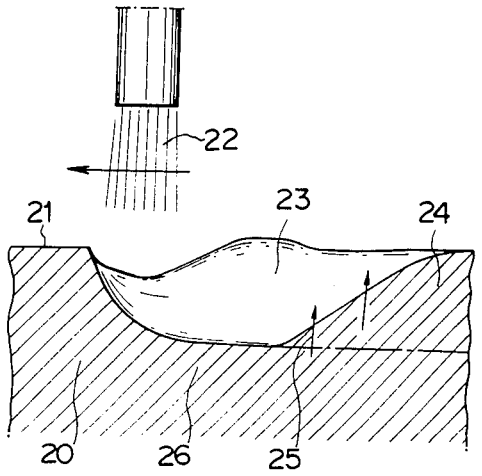
FIG. 4 schematically illustrates the remelting-resolidifyinng process occurring in the surface layer by the present method.
Figure 5:
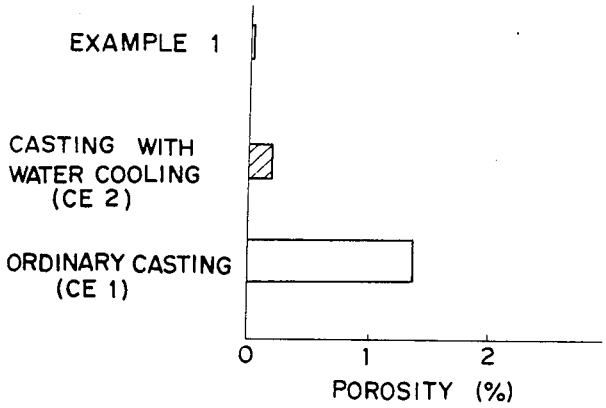
FIGS. 5 to 9 are diagrams showing the results of material quality tests conducted on an inter-valve region of the cylinder heads prepared in Example 1 and Comparative Examples 1 and 2, FIG. 5 showing porosity, FIG. 6 showing density, FIG. 7 showing tensile strength, FIG. 8 showing elongation, and FIG. 9 showing Charpy impact value.
Figure 6:
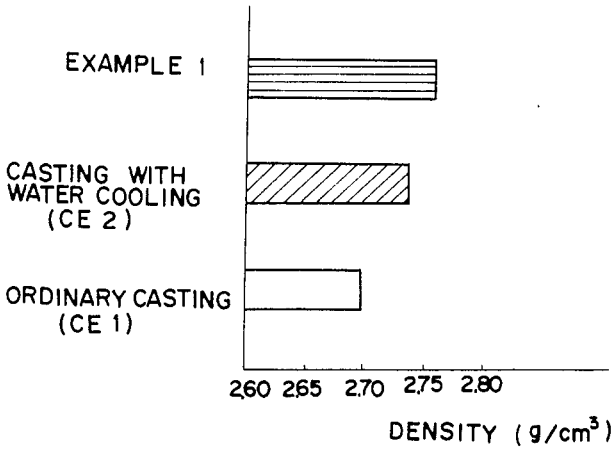
Figure 7:
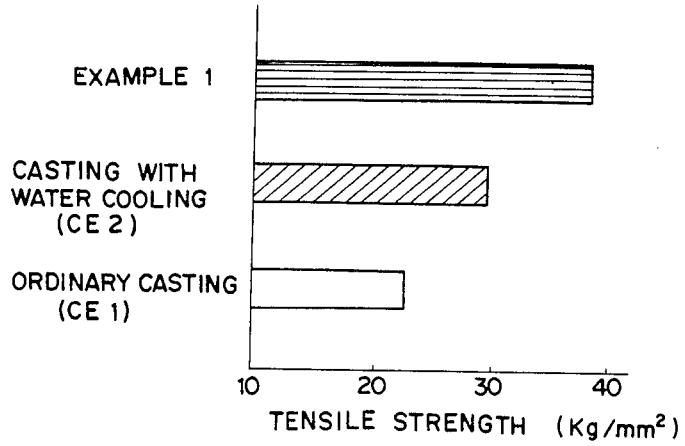
Figure 8:
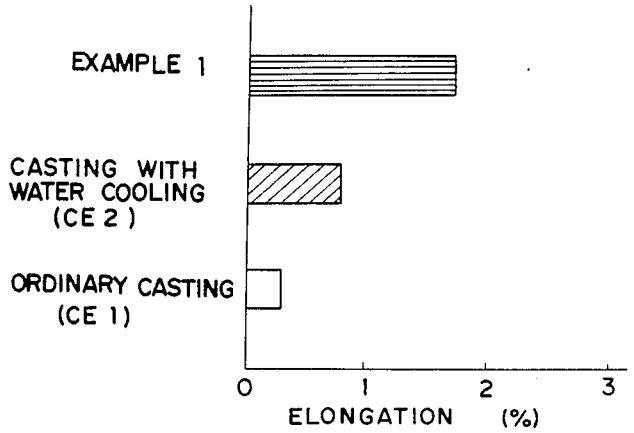
Figure 9:
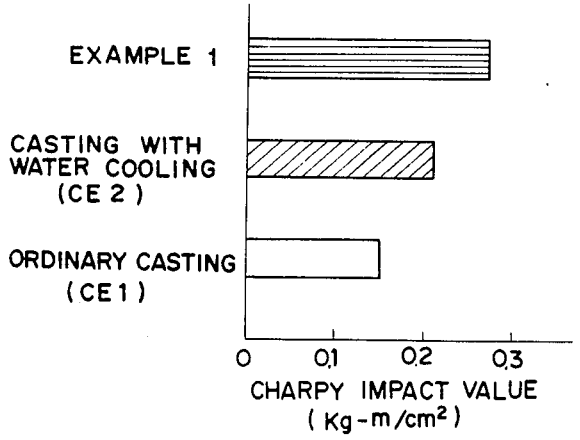

This energy irradiation is schematically illustrated in FIG. 4. A high density energy 22 in the form of TIG arc or laser is directed to a spot on the surface of a selected region of a cast body 20. Then that portion of the aluminum alloy surface layer within the spot is quickly heated and melted to produce a molten aluminum alloy pool 23. As the spot of irradiating energy is moved in the direction of an arrow, the molten aluminum alloy pool 23 is extended in the direction of movement. Movement of the spot of irradiating energy means that the irradiating energy is removed or taken away from the initial spot where heat transfer occurs quickly from the molten aluminum alloy pool 23 to the underlying matrix 26. As a result of heat transfer, the molten aluminum alloy pool 23 lowers its temperature and solidifies to form a solidified layer 24. Since the mass of the pool 23 of aluminum alloy melted upon exposure to a high density energy is significantly smaller than the overall mass of the cylinder head, the matrix 26 which has not melted functions as a chiller so that heat is quickly transferred from the molten pool 23 to the matrix 26. Consequently, the molten aluminum alloy in the pool 23 quickly solidifies directionally from the matrix 26 side toward the top surface as shown by arrows 25. The directional solidification from the matrix side to the surface serves to drive fine defects like pin holes and blow holes which are present in the cast body before remelting, out of the surface layer. Larger defects like shrinkage cavities are collapsed during melting so that the solidified layer resulting from resolidification is free of such larger defects. At the same time, quick solidification serves to render the solidification structure finer. By conducting the rapid remelting-rapid resolidification treatment by the irradiation of a high density energy, a solidified layer 24 which has a fine structure free of defects and improved mechanical properties is formed in the selected regions like the inter-valve region.

The remelted, solidified layer 24 prefereably has a thickness or depth of at least 0.1 mm. Layers of less than 0.1 mm thick are too thin to achieve sufficient improvements in mechanical properties. Thicknesses of at least 0.2 mm are more preferred. Generally, the upper limit is about 2 mm because no additional effect is available from the solidified layer beyond the thickness of about 2 mm.

In the solidification process after the irradiating high density energy having remelted the aluminum alloy surface layer is taken away therefrom, the cooling rate ranges from about 10° to 100° C./sec., usually from about 30° to 50° C./sec. which is significantly faster than the cooling rate of 0.1° to 1° C./sec. during ordinary cylinder head casting.

After the remelting-resolidification process is complete, the resulting surface-treated cylinder head body may be optionally subject to a heat treatment such as, for example, T6 treatment (solid solution treatment-quench hardening-artificial aging), and then to finishing into a final cylinder head shape.

EXAMPLES

Examples of the present invention are presented below by way of illustration and not by way of limitation. Comparative Examples are also presented only for comparison purposes.

EXAMPLE 1

A cylinder head body for a Diesel engine was prepared by melting a JIS AC2B alloy (Cu 2.7 wt %, Si 6.2 wt %, Mg 0.1 wt %, Zn 0.3 wt %, Fe 0.3 wt %, Mn 0.1 wt %, balance Al) and casting the molten alloy by the low pressure mold casting technique. The inter-valve region 4 of the cast cylinder head body disposed between intake and exhaust ports 2 and 3 as shown in FIG. 1 was scanned with TIG arc for rapid remelting followed by rapid solidification. The remelting by TIG arc was effected by using a tungsten electrode rod having a diameter of 3.2 mm and passing argon gas at 25 liters/-min. as a shielding gas. The electricity used had a peak current of 210 amperes and a base current of 180 amperes, and the torch was moved at a speed of 0.75 mm/sec. The cooling rate after removal of the TIC arc was observed to be 30° to 50° C./sec.

After the inter-valve region 4 was remelted and resolidified in this way, the cylinder head body was heat treated. The heat treatment was T6 treatment. Thus the body was heated at 500° C. for 5 hours, quenched with water at 70° C., and then heated for aging at 180° C. for 5 hours.

COMPARATIVE EXAMPLE 1

A cylinder head body for a Diesel engine was cast from the same JIS AC2B alloy by the same low pressure mold casting technique as used in Example 1. The body was subjected to the same heat treatment as in Example 1 without the remelting treatment.

COMPARATIVE EXAMPLE 2

A cylinder head body for a Diesel engine was cast from the same JIS AC2B alloy by the same low pressure mold casting technique as used in Example 1. A water cooling pipe was inserted into the mold so as to rapidly cool the inter-valve region of the cylinder head body being cast.

The cast cylinder heads obtained from Example 1 and Comparative Example 1 were finished by ordinary machining, incorporated in Diesel engines, and subjected to an endurance test. The endurance test was carried out by operating the actual engines at 4700 rpm under full load conditions and at 1000 rpm under non-load conditions.

In the endurance tests, it was observed that microcracks developed in the inter-valve region of the cylinder head from Comparative Example 1 after 100 to 200 hours whereas no abnormality was observed in the cylinder head from Example 1 even after 300 hours of continuous operation.

Test specimens were cut out from the inter-valve region of the cylinder heads from Example 1 and Comparative Examples 1 and 2. They were measured for density, porosity, tensile strength, elongation, and Charpy impact value. The results of these tests are shown in FIGS. 5 to 9. As seen from FIGS. 5 to 9, the body cast with the aid of water cooling (Comparative Example 2) is noticeably reduced in porosity and increased in density as compared with the ordinary casting (Comparative Example 1), indicating a significant loss of defects. Likewise, tensile strength, elongation, and Charpy impact value are improved. The remelted, resolidified casting of the present invention (Example 1) is further increased in density as compared with the casting of Comparative Example 2 and has an extremely low porosity. This indicates that the treated region of the cast body of Example 1 is substantially free of a defect. Likewise, the mechanical properties of tensile strength, elongation, and Charpy impact value are improved over the cast body of Comparative Example 2.

Figure 10:
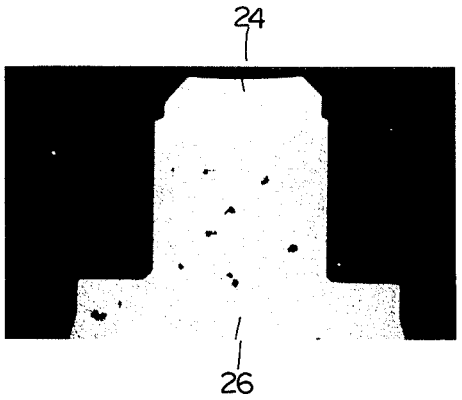
FIG. 10 is a photomicrograph (3×) showing in cross section the structure of an inter-valve region of the cylinder head prepared in Example 1.

The cylinder head of Example 1 was cut along lines X—X in FIG. 1 to observe the cross section. FIG. 10 is a photograph of the cross section in an enlarged scale. It is evident that micropores indicative of casting defects are present in the matrix 26, but the remelted, resolidified layer 24 is free of a pore and has a very fine structure.

EXAMPLE 2

A cylinder head body for a gasoline engine as shown in FIG. 2 was cast from the same JIS AC2B alloy by the same low pressure mold casting technique as used in Example 1. In order to increase laser absorption, the inter-valve region 14 of the cast body was coated with a 1/1 mixture of carbon black and polyvinyl alcohol followed by drying. The region was subjected to a remelting-resolidifying treatment by means of a $CO_2$ laser processing machine operated at an output of 4 kW. The laser used had a power density of 83 W/mm$^2$ and an energy density of 500 J/mm$^2$. The beam moving speed was 1 mm/sec. and argon gas was fed at 60 liters/min. as an assisting gas. The cooling rate after remelting was observed to be 30° to 50° C./sec.

After the remelting-resolidifying treatment by laser, the surface-treated body was further subjected to a heat treatment and finishing by the same procedures as in Example 1.

The remelted, resolidified layer in the inter-valve region of the resulting cylinder head was found to be essentially free of a casting defect and have a fine structure as in the case of Example 1.

According to the present method for manufacturing a cylinder head of cast aluminum alloy for internal combustion engines, a high density energy is directed to the selected region of a cylinder head body cast from an aluminum alloy to thereby heat and rapidly remelt the region, and the molten mass is then rapidly cooled for resolidification. There is obtained a benefit of fully improving the mechanical properties of the high load-bearing regions of the cylinder head like inter-valve regions while maintaining the advantages characteristic of aluminum alloy castings including light weight, cooling performance, and compactness. In addition, a number of cast bodies can be quickly and continuously treated in a relatively simple manner without any probable danger.

We claim:

1. A method for manufacturing a cylinder head of cast aluminum alloy for internal combustion engines, comprising the steps of casting a cylinder head body from an aluminum alloy, directing a high density irradiating of at least one region of said cylinder head body where a high strength is required, thereby rapidly remelting a surface layer in said region, and subsequently removing the irradiating energy and allowing the molten aluminum alloy of the surface layer to be rapidly cooled and solidified through heat transfer therefrom to the underlying matrix, thereby forming a remelted, solidified layer.

2. A method according to claim 1 wherein the high density energy is selected from TIG arc, laser, plasma arc, or electron beam.

3. A method according to claim 1 wherein said cylinder head body has a plurality of valve ports formed therein and said region is that region of the cylinder head body disposed between adjoining valve ports.

4. A method according to claim 1 wherein said cylinder head body has a port for receiving a spark plug therein and said region is that region of the cylinder head body disposed adjacent the port.

5. The method according to claim 1 wherein said cylinder head is intended for Diesel engines and has an aperture for communication with an auxiliary combustion chamber and said region is that region of the cylinder head body disposed adjacent the aperture.

6. A method according to claim 1 wherein said cylinder head is intended for Diesel engines and has an aperture for communication with an auxiliary combustion chamber and a plurality of valve ports formed therein, and said region is that region of the cylinder head body disposed between the aperture and the valve ports.

7. A method according to claim 1 wherein said remelted, solidified layer has a thickness of at least 0.1 mm.

* * * * *